US010132239B2

(12) United States Patent
Liu

(10) Patent No.: US 10,132,239 B2
(45) **Date of Patent: *Nov. 20, 2018**

(54) ON-LINE CLEANING SYSTEM AND CONTROL METHOD FOR CARBON DEPOSIT IN ENGINE INTAKE VALVE AND COMBUSTION CHAMBER

(71) Applicant: Xinyu Liu, Beijing (CN)

(72) Inventor: Xinyu Liu, Beijing (CN)

( * ) Notice: Subject to any disclaimer, the term of this patent is extended or adjusted under 35 U.S.C. 154(b) by 342 days.

This patent is subject to a terminal disclaimer.

(21) Appl. No.: 14/910,664

(22) PCT Filed: Sep. 27, 2013

(86) PCT No.: PCT/CN2013/084416
§ 371 (c)(1),
(2) Date: Feb. 5, 2016

(87) PCT Pub. No.: WO2015/027545
PCT Pub. Date: Mar. 5, 2015

(65) Prior Publication Data

US 2016/0186655 A1 Jun. 30, 2016

(30) Foreign Application Priority Data

Sep. 2, 2013 (CN) ..... 2013 1 0389860

(51) Int. Cl.
*F02B 77/04* (2006.01)

(52) U.S. Cl.
CPC ..... *F02B 77/04* (2013.01)

(58) Field of Classification Search
CPC ..... F02B 77/04; F02B 65/007
(Continued)

(56) References Cited

U.S. PATENT DOCUMENTS 5,826,602 A * 10/1998 Chen ..... F02B 77/04 123/198 A
6,073,638 A 6/2000 Sasaki et al. ..... 134/22.18
(Continued)

FOREIGN PATENT DOCUMENTS

CN 201125784 Y 10/2008
CN 203515804 U 4/2014
(Continued)

OTHER PUBLICATIONS

International Search Report of corresponding international application No. PCT/CN2013/084416 dated Jun. 10, 2014.

*Primary Examiner* — Marguerite McMahon
*Assistant Examiner* — James Kim
(74) *Attorney, Agent, or Firm* — J.C. Patents

(57) ABSTRACT

The present invention discloses an on-line cleaning system and control method for carbon deposit in engine intake valve and combustion chamber comprising a cleaning agent tank, a cleaning agent inlet line and a control circuit, the control circuit comprises a cleaning work procedure, and is provided with a cleaning start-up circuit, the cleaning agent tank is disposed on a frame within the automobile engine hood, one end of the cleaning agent inlet line is connected to the cleaning agent tank, the other end of the cleaning agent inlet line is connected to an engine vacuum pipeline which is a vacuum pipeline in communication with the automobile engine intake valve, a control signal at the automobile engine operating state is connected with the start-up circuit in the control circuit. The on-line cleaning of the carbon deposit in engine intake valve and combustion chamber is achieved without changing the existing automobile basic design, and the control method is simple and practical. A closed-loop automatic control of the cleaning agent inflow amount and the vacuum pressure is achieved; the cleaning
(Continued)

process is safe and reliable, and the environmental performance of the engine emission is improved.

9 Claims, 3 Drawing Sheets

(58) Field of Classification Search
USPC ..... 123/198 A; 134/102.1
See application file for complete search history.

(56) References Cited

U.S. PATENT DOCUMENTS

| | | | | |
|---|---|---|---|---|
| 6,178,977 | B1 | 1/2001 | Wells | 134/102.1 |
| 6,304,815 | B1 * | 10/2001 | Moraal | F01N 3/035 60/285 |
| 6,357,674 | B1 | 3/2002 | Nakashima | 239/373 |
| 8,926,763 | B2 * | 1/2015 | Ogasawara | F02B 77/04 134/21 |
| 9,752,499 | B2 * | 9/2017 | Liu | B08B 9/0865 |
| 2006/0201472 | A1 * | 9/2006 | Kerns | F01L 13/00 123/198 A |

FOREIGN PATENT DOCUMENTS

| | | |
|---|---|---|
| DE | 199 58 177 A | 1/2001 |
| WO | WO00/33981 | 6/2000 |

* cited by examiner

| P Kpa | 75 ~ 61 | 61 ~ 56 | 56 ~ 51 | 51 ~ 46 | 46 ~ 41 | 41 ~ 36 | 36 ~ 31 | 31 ~ 26 | 26 ~ 21 |
|---|---|---|---|---|---|---|---|---|---|
| T MS | 18.2 | 17.2 | 16.4 | 14.7 | 14 | 13.4 | 12.4 | 11 | 10 |

FIG. 3

| P ( Kpa ) | 61 | 56 | 51 | 46 | 41 | 36 | 31 | 26 | 21 |
|---|---|---|---|---|---|---|---|---|---|
| V( v ) | 2.67 | 2.41 | 2.14 | 1.88 | 1.61 | 1.34 | 1.08 | 0.82 | 0.55 |
| T ( MS ) | 18.2 | 17.2 | 16.4 | 14.7 | 14 | 13.4 | 12.4 | 11 | 10 |
| L (g/min) | 13.6 | 13.8 | 13.2 | 13.5 | 13.5 | 13.3 | 13.5 | 13.6 | 13.4 |

FIG. 4

ON-LINE CLEANING SYSTEM AND CONTROL METHOD FOR CARBON DEPOSIT IN ENGINE INTAKE VALVE AND COMBUSTION CHAMBER

FIELD OF THE INVENTION

The present invention relates to automobile engine peripheral devices, and more particularly to an on-line cleaning system and control method for carbon deposit in engine intake valve and combustion chamber.

BACKGROUND ART

Because of oil quality problems, road traffic conditions and environments and poor driving habits, automobiles, after traveling several thousand kilometers, will produce carbon deposit and colloid in the intake valve and combustion chamber in the engine fuel system, especially GDI engines produce carbon deposit and colloid in the intake valve and combustion chamber more seriously.

The carbon deposit and colloid in the engine intake valve and combustion chamber are major factors that result in engine performance degradation, insufficient power, increased fuel consumption and super-standard emission, and have always plagued the automobile manufacturers and users.

There're two conventional methods for cleaning the carbon deposit and colloid in the intake valve and combustion chamber: one is periodically adding fuel additive to the fuel tank and cleaning the carbon deposit and colloid in the above-mentioned parts, such a manner is inconvenient for the automobile users; the other one is professional cleaning made to the above-mentioned parts with devices in automobile maintenance stations, the major problem with this manner is the long cleaning period and the high cost. The actual situation is that the carbon deposit and colloid in the intake valve and combustion chamber are not often cleaned for many automobiles, so that the fuel is wasted and the environment is contaminated.

In recent years, governments including China, especially the United States and European countries, are putting more and more emphasis on the environmental pollution problem caused by automobiles and are all improving automotive emission standards, causing large automotive manufacturing companies around the world to improve and perfect the conventional automobile engines and launch novel engines, such novel engines employ GDI+TURBO techniques, GDI is an in-cylinder direct injection technique, which allows more complete combustion of the fuel, enhances fuel economy and reduces exhaust emissions, TURBO is a turbocharging technique, which allows the engine to have a minimized volume and save materials and to be more powerful.

However, there's a great conflict between fuel quality requirements of novel engines and present situation of fuel quality, leading to appearance of more serious carbon deposit in intake valves and combustion chambers of novel engines, especially the carbon deposit in intake valves limits the exertion of advanced performance of novel engines, which can not desirably improve power, save fuels and reduce emissions.

Meanwhile, since the fuel injection nozzle is directly mounted in the combustion chamber for the GDI engine, and conventional methods which add cleaning agents to the fuel tank have been unable to clean the carbon deposit in the intake valve; the TURBO technique results in a high temperature of the engine lubricating oil, the crankcase oil exhaust gas is more liable to form drum-type carbon deposit on the intake valve lever, which severely affects the intake effect, affects the air-fuel ratio, and even leads to the occurrence of pushed valve phenomenons.

It has been a pressing problem to clean the carbon deposit and colloid in the GDI engine intake valve and combustion chamber and sufficiently exert the engine performance

SUMMARY OF THE INVENTION

The object of the present invention is to provide an on-line cleaning system and control method for carbon deposit in engine intake valve and combustion chamber, a closed-loop control is formed by the system and the engine electronic control system, and this cleaning system can be automatically started up after the automobile travels a certain kilometers, achieving frequent cleaning of the carbon deposit in the intake valve and the combustion chamber.

In order to achieve the above objects, the technical solutions of the present invention are:

An on-line cleaning system for carbon deposit in engine intake valve and combustion chamber, this system is one system that can clean the carbon deposit in intake valve and combustion chamber while the automobile is driving, comprising a cleaning agent tank, a cleaning agent inlet line and a control circuit, the cleaning agent tank is filled with intake valve cleaning agents, the control circuit comprises a cleaning work procedure which controls turn-on and turn-off of the cleaning agent inlet line; wherein, the control circuit is provided with a cleaning start-up circuit, the cleaning agent tank is disposed on a frame within the automobile engine hood, one end of the cleaning agent inlet line is connected to the cleaning agent tank, the other end of the cleaning agent inlet line is connected to an engine vacuum pipeline which is a vacuum pipeline in communication with the automobile engine intake valve, a control signal at the automobile engine operating state is connected with the start-up circuit in the control circuit.

The solutions are further: the cleaning agent inlet line from the engine vacuum pipeline to the cleaning agent tank is sequentially connected with a vacuum pressure sensor and an electromagnetic flow controller, respectively; the control circuit is provided with a vacuum pressure measuring interface and an electromagnetic flow control interface, the electrical output signal of the vacuum pressure sensor is connected to the vacuum pressure measuring interface, and the electromagnetic flow control interface is connected with the electrical signal control input of the electromagnetic flow controller.

The solutions are further: the vacuum pipeline in communication with the automobile engine intake valve is the vacuum pipeline disposed in a pipeline between a throttle and an engine intake manifold.

The solutions are further: the control signal is a push-button switch signal and the start-up circuit is a signal trigger, when the push-button switch is pressed as the engine runs, the signal trigger triggers the control circuit into the cleaning work procedure.

The solutions are further: the control signal is a mileage count signal of the automobile, the start-up circuit is a mileage count controller provided with a preset mileage register and a mileage counter in numerical comparison with the mileage register, the mileage count signal is connected to the count input of the mileage counter, when the mileage value of the mileage counter reaches a preset value of the preset mileage register, the output of the mileage count controller triggers the control circuit into the cleaning work procedure.

A control method based on an on-line cleaning system for carbon deposit in engine intake valve and combustion chamber is a control method which can clean the carbon deposit in intake valve and combustion chamber while the automobile is driving, the system comprises a cleaning agent tank, a cleaning agent inlet line and a control circuit, one end of the cleaning agent inlet line is connected to the cleaning agent tank, the other end of the cleaning agent inlet line is connected to an engine vacuum pipeline which is a vacuum pipeline disposed in a pipeline between a throttle and an engine intake manifold, the control circuit comprises a cleaning work procedure which controls turn-on and turn-off of the cleaning agent inlet line; the control circuit is provided with a cleaning start-up circuit comprising a preset mileage register and a mileage counter in numerical comparison with the mileage register, an automobile driving mileage count signal is connected to the mileage counter; steps of the control method are:

a. Inputting a preset mileage number into the preset mileage register, the preset mileage number is such a mileage that cleaning the carbon deposit in intake valve and combustion chamber is required after the travelling distance of the automobile has reached the mileage;

b. Starting up the automobile engine;

c. Reading the mileage data in the mileage counter, and comparing the mileage data with the preset mileage number;

d. Starting up the cleaning work procedure and zero clearing the mileage counter when the mileage data is equal to the preset mileage number, and returning to step c when the mileage data is smaller than the preset mileage number;

The cleaning work procedure is: at the engine operating state, when the vacuum pressure value is in the range between 75 kPa and 20 kPa, inputting the cleaning agent with a flow of 5-13.5 g/min into the cleaning agent inlet pipe to clean the engine intake valve and combustion chamber; the cleaning time is 15-25 mins.

The solutions are further: the preset mileage number is 2000 km.

The solutions are further: the cleaning work procedure is: at the engine operating state, when the vacuum pressure value is in the range between 50 kPa and 40 kPa, inputting the cleaning agent with a flow of 6±0.3 g/min into the cleaning agent inlet pipe to clean the engine intake valve and the combustion chamber, the cleaning time is 20 mins.

The method is further: dividing the pressures in the vacuum pressure value range into a plurality of pressure zones, setting different cleaning agent introduction times for each pressure zone seperately, the ranges of the different introduction times are between 10 microseconds and 18.2 microseconds, and the total inhalation amount of the cleaning agent during the set overall introduction time is between 5 g/min and 13.5 g/min The present invention has the following advantages compared to the prior art:

1. The on-line cleaning of carbon deposit in engine intake valve and combustion chamber is achieved without changing the existing basic design of the automobile, and the control method is simple and practical.

2. A closed-loop automatic control of the cleaning agent inflow amount and the vacuum pressure is achieved; the cleaning quality of the engine intake valve and the combustion chamber is guaranteed, the engine knocking accident is avoided, the maximum efficacy of the novel engine is exerted, and the environmental performance of the engine emission is improved.

Hereinafter, the present invention will be described in detail with reference to the accompanying drawings and embodiments.

BRIEF DESCRIPTION OF THE DRAWINGS

FIG. 3 is a table illustrating the relationship between the flow control time values and the vacuum pressure values according to the present invention;

FIG. 4 is a table illustrating the relationship between the flow control values actually measured and the vacuum pressure values according to the present invention.

DETAILED DESCRIPTION OF THE INVENTION

Embodiment 1

Figure 1:
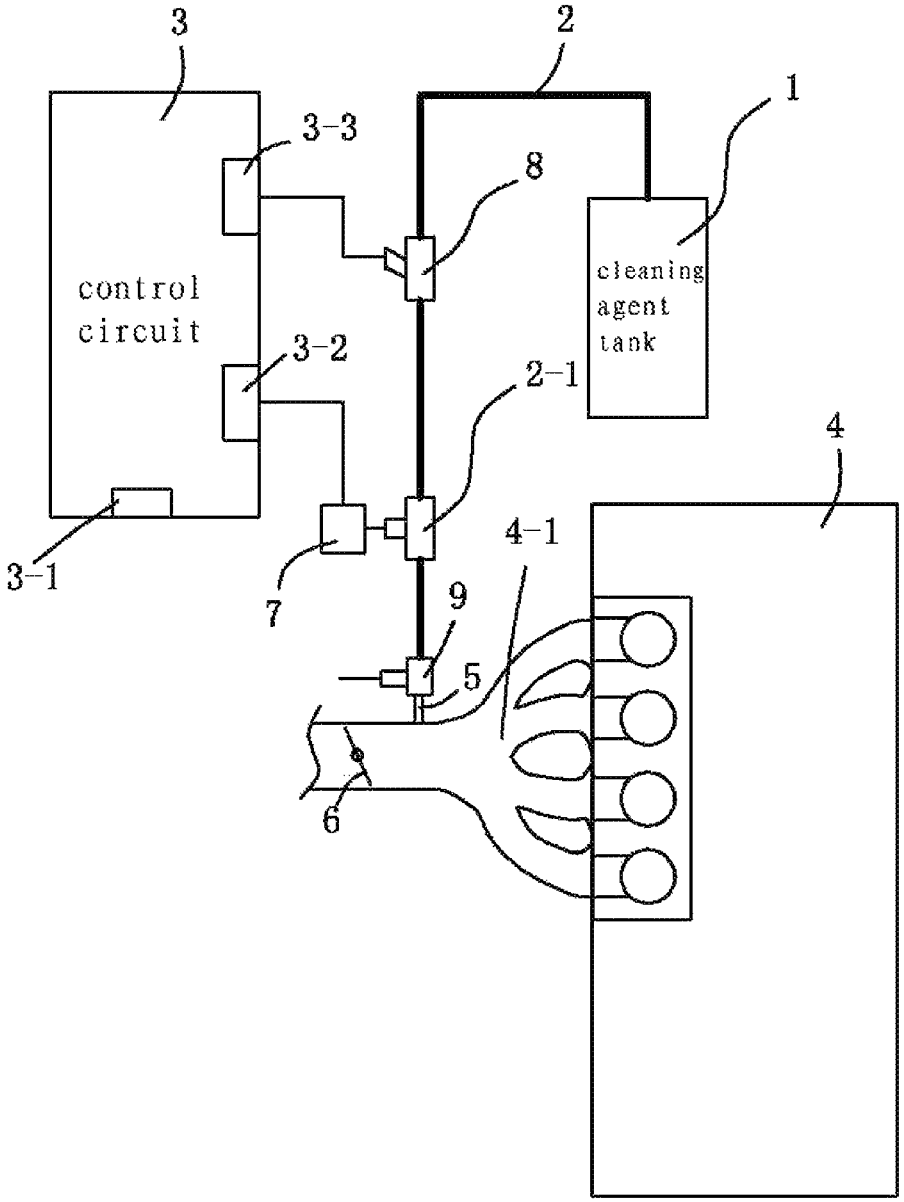
FIG. 1 is a schematic view of the structure of the present invention.
Figure 2:
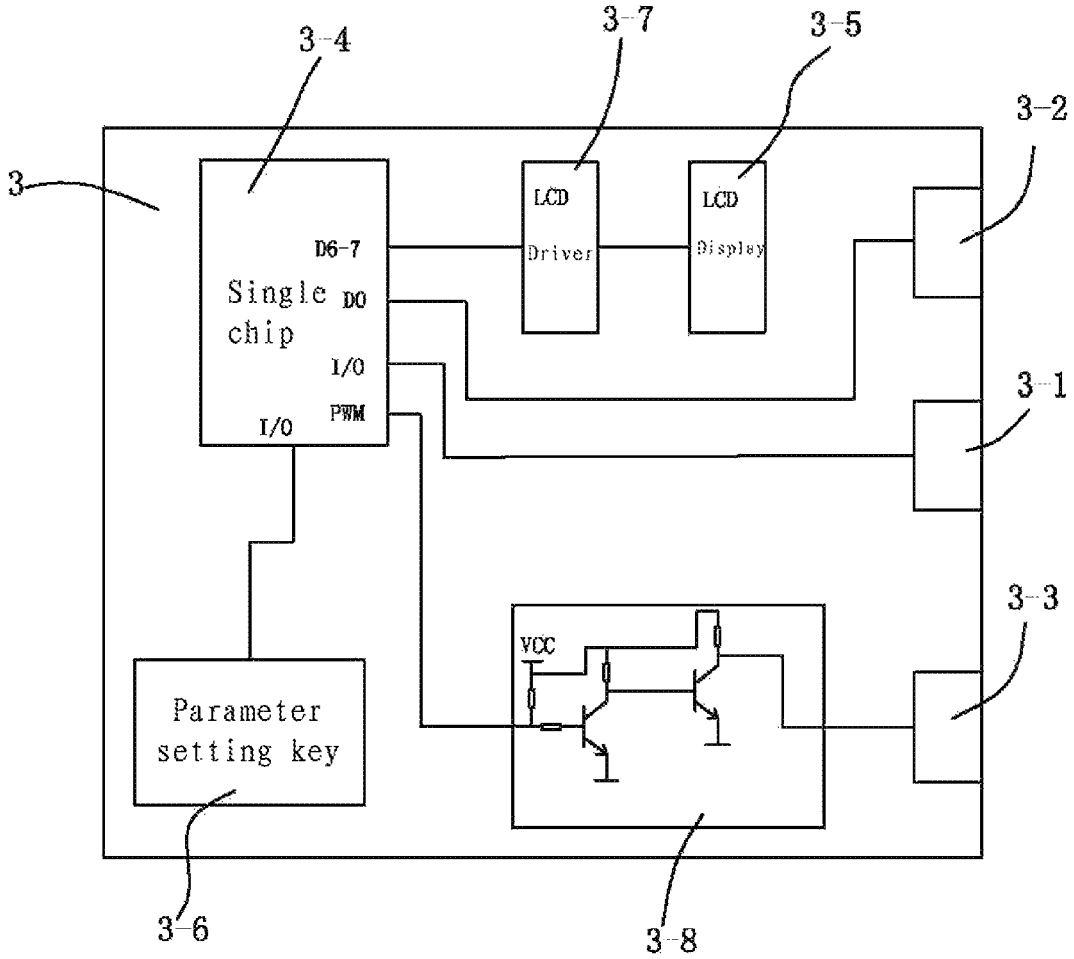
FIG. 2 is a schematic view of the electronic control principle of the present invention.

An embodiment of an on-line cleaning system for carbon deposit in engine intake valve and combustion chamber, this system is a one system that can clean the carbon deposit in intake valve and combustion chamber while the automobile is driving, comprising a cleaning agent tank 1, a cleaning agent inlet line 2 and a control circuit 3, the cleaning agent tank is filled with intake valve cleaning agents, the control circuit comprises a cleaning work procedure which controls turn-on and turn-off of the cleaning agent inlet line; wherein, the control circuit is provided with a cleaning start-up circuit 3-1, the cleaning agent tank is disposed on a frame within the automobile engine hood, one end of the cleaning agent inlet line is connected to the cleaning agent tank, the other end of the cleaning agent inlet line is connected to an vacuum pipeline of the engine 4 which is a vacuum pipeline in communication with the automobile engine intake valve, a control signal 5 at the automobile engine operating state is connected with the start-up circuit in the control circuit.

In the embodiment: the cleaning agent inlet line from the engine vacuum pipeline to the cleaning agent tank is sequentially connected with a vacuum pressure sensor 7 and an electromagnetic flow controller 8, respectively; the control circuit is provided with a vacuum pressure measuring interface 3-1 and an electromagnetic flow control interface 3-2, the electrical output signal of the vacuum pressure sensor is connected to the vacuum pressure measuring interface, and the electromagnetic flow control interface is connected with the electrical signal control input of the electromagnetic flow controller. In the embodiment, the vacuum pressure sensor connects to the cleaning agent inlet line through one tee-junction 2-1 provided in the cleaning agent inlet line. The vacuum pressure sensor in the embodiment is a commercially available vacuum pressure sensor whose model is AT80 series, and the model of the vacuum pressure sensor used in this embodiment is AT8013; the electromagnetic flow controller is an automobile electronically controlled fuel injection nozzle whose model is STN99, and the electronically controlled fuel injection nozzle is concatenated in the cleaning agent inlet line.

In the embodiment: as shown in FIG. 1, the vacuum pipeline in communication with the automobile engine intake valve is the vacuum pipeline 5 disposed in a pipeline between a throttle 6 and an engine intake manifold 4-1. Often, one vacuum pipeline interface is provided here and a line is connected in the automobile. One tee-junction 9 is added at this interface in this embodiment, and in the case it is guaranteed that the original line is unobstructed, the cleaning agent inlet line is connected-in by the provided tee-junction, and the cleaning agents are inhaled to clean the carbon deposit in the inlet valve and the combustion chamber taking advantage of the vacuum pressure of this line at the automobile engine operating state.

There may be mutiple schemes for the control circuit in the above embodiment, the control circuit in this embodiment comprises a single chip 3-4 which contains a modulatable pulse width/pulse frequency output port (PWM) and a plurality of data input/output ports (D0-D7,P1-P3), and a liquid crystal display 3-5, a parameter setting key 3-6, a vacuum pressure measuring interface 3-2 and an electromagnetic flow control interface 3-3 are disposed around the single chip; wherein the liquid crystal display is connected to the data output port of the single chip through the liquid crystal display driver 3-7, the parameter setting keys is connected to the data output port of the single chip, the vacuum pressure measurement interface is the data input port of the single chip, and the electrical flow control interface is the modulatable pulse width/pulse frequency output port.

The single chip described in the embodiment is a commercially available 8-bit single chip with a memory, and what is used in this embodiment is an 8-bit single chip with a 24K flash memory whose model is STC125624, the liquid crystal display driver is of a commercially available model HT1621, and the electromagnetic flow control interface includes the modulatable pulse width/pulse frequency output port and a bipolar transistor drive 3-8 connected with the modulatable pulse width/pulse frequency output port of the single chip.

There are two schemes for the start-up system operation in the embodiment:

The first is: the control signal is a push-button switch signal and the start-up circuit is a signal trigger, when the push-button switch is pressed as the engine runs, the signal trigger triggers the control circuit into the cleaning work procedure. This scheme is to manually control the cleaning operation of the system based on the engine conditions.

The second is: the control signal is a mileage count signal of the automobile, the start-up circuit is a mileage count controller provided with a preset mileage register and a mileage counter in numerical comparison with the mileage register, the mileage count signal is connected to the count input of the mileage counter, when the mileage value of the mileage counter reaches a preset value of the preset mileage register, the output of the mileage count controller triggers the control circuit into the cleaning work procedure. This scheme is an automatic cleaning scheme through inputting a mileage number into the preset mileage register, and the automobile would automatically start up the system when the automobile runs to the set mileage. In this embodiment, the mileage count controller is provided in the single chip described above, and the mileage count signal is connected to the I/O port of the single chip.

Embodiment 2

A control method for on-line cleaning of the carbon deposit in the engine intake valve and combustion chamber, this embodiment is based on the control method of the on-line cleaning system for the carbon deposit in the engine intake valve and combustion chamber in embodiment 1 and is a control method for cleaning the carbon deposit in the intake valve and combustion chamber while the automobile is driving; for understanding of the part in this embodiment which is identical to that in embodiment 1, please refer to the content disclosed in embodiment 1, and the content disclosed in embodiment 1 should also be considered as the content of this embodiment, and description thereof will not be repeated herein.

The system described in this embodiment is the system of the second scheme for starting up the system operation in embodiment 1, comprising a cleaning agent tank, a cleaning agent inlet line and a control circuit, one end of the cleaning agent inlet line is connected to the cleaning agent tank, the other end of the cleaning agent inlet line is connected to an engine vacuum pipeline which is a vacuum pipeline disposed in a pipeline between a throttle and an engine intake manifold, the control circuit comprises a cleaning work procedure which controls turn-on and turn-off of the cleaning agent inlet line; the control circuit is provided with a cleaning start-up circuit comprising a preset mileage register and a mileage counter in numerical comparison with the mileage register, an automobile driving mileage count signal is connected to the mileage counter; steps of the control method are:

a. Inputting a preset mileage number into the preset mileage register, the preset mileage number is such a mileage that cleaning the carbon deposit in intake valve and combustion chamber is required after the travelling distance of the automobile has reached the mileage;

b. Starting up the automobile engine;

c. Reading the mileage data in the mileage counter, and comparing the mileage data with the preset mileage number;

d. Starting up the cleaning work procedure and zero clearing the mileage counter when the mileage data is equal to the preset mileage number, and returning to step c when the mileage data is smaller than the preset mileage number;

The cleaning work procedure is: at the engine operating state, when the vacuum pressure value is in the range between 75 kPa and 20 kPa, inputting the cleaning agent with a flow of 5-13.5 g/min into the cleaning agent inlet pipe to clean the engine intake valve and combustion chamber; the cleaning time is 15-25 mins.

In the embodiment, the preferred data about the preset mileage is: the preset mileage number is 2000 km.

In the embodiment, the rest of preferred datum are: the cleaning work procedure is: at the engine operating state, when the vacuum pressure value is in the range between 50 kPa and 40 kPa, inputting the cleaning agent with a flow of 6±0.3 g/min into the cleaning agent inlet pipe to clean the engine intake valve and the combustion chamber, the cleaning time is 20 mins.

Wherein, the method is further: the manner for inputting the cleaning agents into the cleaning agent inlet line is dividing the pressures in the vacuum pressure value range into a plurality of pressure zones, setting different cleaning agent introduction times for each pressure zone seperately, the ranges of the different introduction times are between 10 microseconds and 18.2 microseconds, and the total inhalation amount of the cleaning agent during the set overall introduction time is between 5 g/min and 13.5 g/min In the embodiment, the vacuum pressure signal is transferred into a voltage signal and sent to the cleaning agent flow control circuit by the vacuum pressure sensor; the relationship between the vacuum pressure (P) and voltage (V) is: $V=0.053\ P-0.56$ (this relationship is well known, the unit of the pressure P is kPa and that of the voltage is volt);

In the embodiment, the turn-on flow of the electromagnetic flow controller is determined by the turn-on time of the electromagnetic valve.

The range between the maximum pressure value and the minimum pressure value of the vacuum pressure is divided into a plurality of pressure zones, and a plurality of turn-on times for the electromagnetic flow controllers corresponding to the plurality of pressure zones are set.

The number of the pressure zones is one of 5, 6, 7, 8 and 9, and the more zones divided into, the more accurate the control will be.

The table of the relationship between the turn-on time and the vacuum pressure of the electromagnetic flow controller which is an electronically controlled fuel injection nozzle whose model is STN99 in this embodiment is as shown in FIG. 3.

In the embodiment, the maximum pressure value of the vacuum pressure is 75 Kpa, and the minimum pressure value of the vacuum pressure is 20 KPa.

The vacuum pressures of intake lines will be different for different automobile engines; the vacuum pressures of intake lines will also be different for different engine rotational speeds ; all these factors will affect the flow of the cleaning agents inhaled by the engine, so 9 sub-pressure ranges are contained in the pressure value range between 75 kPa vacuum pressure and 20 kPa vacuum pressure, and the 9 sub-pressure ranges are 75 kPa to 61 kPa, 61 kPa to 56 kPa, 56 kPa to 51 kPa, 51 kPa to 46 kPa, 46 kPa to 41 kPa, 41 kPa to 36 kPa, 36 kPa to 31 kPa, 31 kPa to 26 kPa and 26 kPa to 21 kPa, respectively; the turn-on time of the electromagnetic flow controller set corresponding to the range of 75 kPa to 61 kPa is 18.2 milliseconds; the turn-on time of the electromagnetic flow controller set corresponding to the range of 61 kPa to 56 kPa is 17.2 milliseconds; the turn-on time of the electromagnetic flow controller set corresponding to the range of 56 kPa to 51 kPa is 16.4 milliseconds; the turn-on time of the electromagnetic flow controller set corresponding to the range of 51 kPa to 46 kPa is 14.7 milliseconds; the turn-on time of the electromagnetic flow controller set corresponding to the range of 46 kPa to 41 kPa is 14 milliseconds; the turn-on time of the electromagnetic flow controller set corresponding to the range of 41 kPa to 36 kPa is 13.4 milliseconds; the turn-on time of the electromagnetic flow controller set corresponding to the range of 36 kPa to 31 kPa is 12.4 milliseconds; the turn-on time of the electromagnetic flow controller set corresponding to the range of 31 kPa to 26 kPa is 11 milliseconds; the turn-on time of the electromagnetic flow controller set corresponding to the range of 26 kPa to 21 kPa is 10 milliseconds.

FIG. 4 is an actual measurement table of the cleaning agent flow corresponding to a specific point in the 9 ranges. The voltage values in the table are obtained according to the relational expression between the vacuum pressure (P) and the voltage (V), which are also actually measured voltage values.

The specific operation process is: the electromagnetic flow controller is turned off when the voltage signal (Vm) measured by the vacuum sensor is greater than 3.4 volts; when the voltage signal (Vm) measured by the vacuum sensor is greater than 2.67 volts and smaller than 3.4 volts, the turn-on time (T) of the electromagnetic flow controller is 18.2 milliseconds, and the corresponding actually measured flow (L) is 13.6 g/min; extending the analogy, when the voltage signal (Vm) measured by the vacuum sensor is smaller than 0.55 volts, the electromagnetic flow controller is turned off.

What is claimed is:

1. An on-line cleaning system for carbon deposit in engine intake valve and combustion chamber comprising a cleaning agent tank, a cleaning agent inlet line and a control circuit, the cleaning agent tank being filled with intake valve cleaning agents, the control circuit comprising a cleaning work procedure which controls turn-on and turn-off of the cleaning agent inlet line; wherein, the control circuit is provided with a cleaning start-up circuit, the cleaning agent tank is disposed on a frame within the automobile engine hood, one end of the cleaning agent inlet line is connected to the cleaning agent tank, the other end of the cleaning agent inlet line is connected to an engine vacuum pipeline which is a vacuum pipeline in communication with the automobile engine intake valve, a control signal at the automobile engine operating state is connected with the start-up circuit in the control circuit.

2. The on-line cleaning system for carbon deposit in engine intake valve and combustion chamber according to claim 1, wherein the cleaning agent inlet line from the engine vacuum pipeline to the cleaning agent tank is sequentially connected with a vacuum pressure sensor and an electromagnetic flow controller, respectively; the control circuit is provided with a vacuum pressure measuring interface and an electromagnetic flow control interface, the electrical output signal of the vacuum pressure sensor is connected to the vacuum pressure measuring interface, and the electromagnetic flow control interface is connected with the electrical signal control input of the electromagnetic flow controller.

3. The on-line cleaning system for carbon deposit in engine intake valve and combustion chamber according to claim 1, wherein the vacuum pipeline in communication with the automobile engine intake valve is the vacuum pipeline disposed in a pipeline between a throttle and an engine intake manifold.

4. The on-line cleaning system for carbon deposit in engine intake valve and combustion chamber according to claim 1, wherein the control signal is a push-button switch signal and the start-up circuit is a signal trigger, when the push-button switch is pressed as the engine runs, the signal trigger triggers the control circuit into the cleaning work procedure.

5. The on-line cleaning system for carbon deposit in engine intake valve and combustion chamber according to claim 1, wherein the control signal is a mileage count signal of the automobile, the start-up circuit is a mileage count controller provided with a preset mileage register and a mileage counter in numerical comparison with the mileage register, the mileage count signal is connected to the count input of the mileage counter, when the mileage value of the mileage counter reaches a preset value of the preset mileage register, the output of the mileage count controller triggers the control circuit into the cleaning work procedure.

6. A control method based on an on-line cleaning system for carbon deposit in engine intake valve and combustion chamber, the system comprising a cleaning agent tank, a cleaning agent inlet line and a control circuit, one end of the cleaning agent inlet line being connected to the cleaning agent tank, the other end of the cleaning agent inlet line being connected to an engine vacuum pipeline which is a vacuum pipeline disposed in a pipeline between a throttle and an engine intake manifold, the control circuit comprising a cleaning work procedure which controls turn-on and turn-off of the cleaning agent inlet line; the control circuit being provided with a cleaning start-up circuit comprising a preset mileage register and a mileage counter in numerical comparison with the mileage register, an automobile driving mileage count signal being connected to the mileage counter; wherein, steps of the control method are:

a. Inputting a preset mileage number into the preset mileage register, the preset mileage number is such a mileage that cleaning the carbon deposit in intake valve and combustion chamber is required after the travelling distance of the automobile has reached the mileage;

b. Starting up the automobile engine;

c. Reading the mileage data in the mileage counter, and comparing the mileage data with the preset mileage number;

d. Starting up the cleaning work procedure and zero clearing the mileage counter when the mileage data is equal to the preset mileage number, and returning to step c when the mileage data is smaller than the preset mileage number;

The cleaning work procedure is: at the engine operating state, when the vacuum pressure value is in the range between 75 kPa and 20 kPa, inputting the cleaning agent with a flow of 5-13.5 g/min into the cleaning agent inlet pipe to clean the engine intake valve and combustion chamber; the cleaning time is 15-25 mins.

7. The control method based on an on-line cleaning system for carbon deposit in engine intake valve and combustion chamber according to claim 6, wherein the preset mileage number is 2000 km.

8. The control method based on an on-line cleaning system for carbon deposit in engine intake valve and combustion chamber according to claim 6, wherein the cleaning work procedure is: at the engine operating state, when the vacuum pressure value is in the range between 50 kPa and 40 kPa, inputting the cleaning agent with a flow of 6±0.3 g/min into the cleaning agent inlet pipe to clean the engine intake valve and the combustion chamber, the cleaning time is 20 mins.

9. The control method based on an on-line cleaning system for carbon deposit in engine intake valve and combustion chamber according to claim 6, wherein the method is further: dividing the pressures in the vacuum pressure value range into a plurality of pressure zones, setting different cleaning agent introduction times for each pressure zone seperately, the ranges of the different introduction times are between 10 microseconds and 18.2 microseconds, and the total inhalation amount of the cleaning agent during the set overall introduction time is between 5 g/min and 13.5 g/min.

* * * * *